US005737958A

United States Patent [19]

Sainz et al.

[11] Patent Number: 5,737,958

[45] Date of Patent: Apr. 14, 1998

[54] METHOD FOR NECKING CONTAINERS

[75] Inventors: Sergio R. Sainz, Henrico County; Donald R. Haulsee, Chesterfield County; Roger H. Donaldson, Lancaster County, all of Va.

[73] Assignee: Reynolds Metals Company, Richmond, Va.

[21] Appl. No.: 662,371

[22] Filed: Jun. 12, 1996

Related U.S. Application Data

[63] Continuation-in-part of Ser. No. 591,877, Jan. 25, 1996, which is a continuation-in-part of Ser. No. 320,999, Oct. 11, 1994, abandoned.

[51] Int. Cl.[6] ..... B21D 22/00; B21D 22/21

[52] U.S. Cl. ..... 72/356; 72/348; 413/69

[58] Field of Search ..... 72/347, 348, 349, 72/352, 354.6, 356, 370; 413/69, 76

[56] References Cited

U.S. PATENT DOCUMENTS 3,845,653 11/1974 Hilgenbrink ..... 72/354

4,519,232 5/1985 Traczyk et al. ..... 413/69

5,355,710 10/1994 Diekhoff ..... 413/69

*Primary Examiner*—Lowell A. Larson

*Assistant Examiner*—Rodney A. Butler

*Attorney, Agent, or Firm*—Robert C. Lyne, Jr.

[57] ABSTRACT

A method of die-necking the open end of a can body to form a reduced diameter neck having a smooth profile comprising forming a reduced neck at the open end of the cylindrical sidewall of the can body by engaging the open end of the sidewall with a die having a multi-radius forming profile, with each successive radius from the entrance to the exit of the die being smaller than the previous radius and with the angle through which each successive radius extends being equal to or smaller than the angle of the previous radius. Then at subsequent die-forming stations, forming progressively smaller reduced diameter necks by a series of dies, all of which preferably have the same multi-radiused forming surface profile which virtually eliminates the undesirable formation of pleats in the final neck configuration.

22 Claims, 5 Drawing Sheets

METHOD FOR NECKING CONTAINERS

RELATED APPLICATIONS

This application is a continuation-in-part of copending application Ser. No. 08/591,877, filed Jan. 25, 1996, which is a continuation-in-part of application Ser. No. 08/320,999, filed Oct. 11, 1994, now abandoned.

BACKGROUND OF THE INVENTION

This invention relates generally to a method of necking in the open end of a cylindrical container and more specifically, to a method of die-necking the open end of a container which includes a plurality of die-necking steps that form a smooth neck configuration on the open end of the can.

It is common practice to provide a reduced diameter neck portion at the top of a thin-walled aluminum cylindrical can body so as to receive a separate end cap onto the mouth of the open end of the can body. Typically, the diameter of the cylindrical body is approximately 2 11/16 inches (a 211 diameter), and the open end of the can may be necked down to a diameter of 2 6/16 inches (a 206 diameter), or even a smaller 2 4/16 inches (a 204 diameter). Various processes which employ a plurality of die-necking steps have been used in attempting to form smooth wall necks. Prior U.S. Pat. Nos. 3,029,507, 3,964,414, 3,995,572, 4,173,883, 4,403,493, 4,527,412, 4,774,839 and 5,297,414 illustrate various processes and equipment for forming the smooth wall necks. However, as the diameter of the finished neck becomes smaller and smaller, it has become more difficult to provide a smooth neck profile which is free of pleats or wrinkles.

We have found that to essentially eliminate wrinkles or pleats in the finished neck, it is desirable to maintain contact of the leading edge of the can with the profiled forming surface of the die in the axial direction of penetration as long as possible before the leading edge contacts the inner guide block or knockout centered within the die. Ideally the leading edge of the can and therefor the entire can wall should maintain contact with the die surface virtually throughout the entire necking process.

In conventional die necking processes in which the forming surface of the die is profiled on a single radius, the can wall leaves the surface of the die before the leading edge contacts the guide block. When this occurs the leading edge is no longer compressed and controlled by the die. For example, a single radius die loses control of the leading edge of the can wall at approximately 0.045 inches before the exit of the die. This lack of control allows the leading edge of the wall to become wrinkled, and the wrinkles become a source of pleats in the finished neck.

For a number of years the assignee of this invention has used a die necking process in which the dies at certain stations have multi-radiused but different profiles, e.g. a large entrance radius of 0.900 inches which acts essentially as a flat and a small exit radius of about 0.100 inches extending through an exit angle greater than 12°. Those die profiles were a significant improvement over the single radius die profiles, maintaining control of the leading edge of the can up to approximately 0.020 inches before the exit of the die and substantially reducing wrinkling problems associated with the single radius profiles.

In those previous die-necking processes, the configuration of the die at one station differed from the die configuration in each of the other stations, thus adding substantially to the cost of the dies.

In addition, it is desirable to minimize the overall length or height of the necked-in portion of the can as to maximize the height of the overall cylindrical portion on the finished can, thereby providing more billboard space on the cylindrical portion for labeling or advertising material. However, unless the necking dies are properly designed, it has been found that decreasing the height of the neck portion leads to the formation of an unacceptable increasing number of wrinkles or pleats in the finished can.

SUMMARY OF THE INVENTION

Accordingly, the primary object of the invention is to provide a novel die-necking process for forming a smooth neck of reduced diameter on the open end of a can in a manner which eliminates wrinkling or pleating, but yet maximizes the available billboard height on the finished can.

Another object of the invention is to provide the novel die necking process in which the necking die has a multi-radius forming profile wherein each successive radius from the entrance to the exit of the die is smaller than the previous radius.

Still another object of the invention is to provide the above novel die necking process wherein the necking die has a double radius profile and the entrance radius is substantially less than 0.900 inches.

Another object of the invention is to provide the above novel die necking process wherein the exit radius extends through an exit angle less than 12°.

Still another object of the invention is to provide the above novel die-necking process including one step in which a necking die moves axially with respect to the open end of the cylindrical sidewall of a can body, engaging the sidewall to form a first reduced diameter neck having a contoured portion extending inwardly from the sidewall to a first cylindrical portion terminating at a terminal edge. The first reduced diameter neck has an axial length corresponding to the desired length of the finished neck on the can. The process further includes subsequent forming steps in which each of the necking dies is preferably of substantially the same multi-radiused configuration, e.g. a double radiused profile, so that the contoured portion of each reduced diameter neck has substantially the same double radiused profile leading into the cylindrical portion of each neck. This feature eliminates pleating and substantially reduces the cost of the necking dies.

Still another object of the invention is to provide the novel process described above, wherein the contoured portion of each neck is formed at a steeper angle with respect to the cylindrical wall thereby reducing the axial length of the finished neck on a can and maximizing the available billboard height on the finished can.

Other objects and advantages of the invention will become apparent from reading the following detailed description of the invention with reference to the accompanying drawings wherein like numerals indicate like elements.

DETAILED DESCRIPTION OF THE INVENTION

Figure 1:
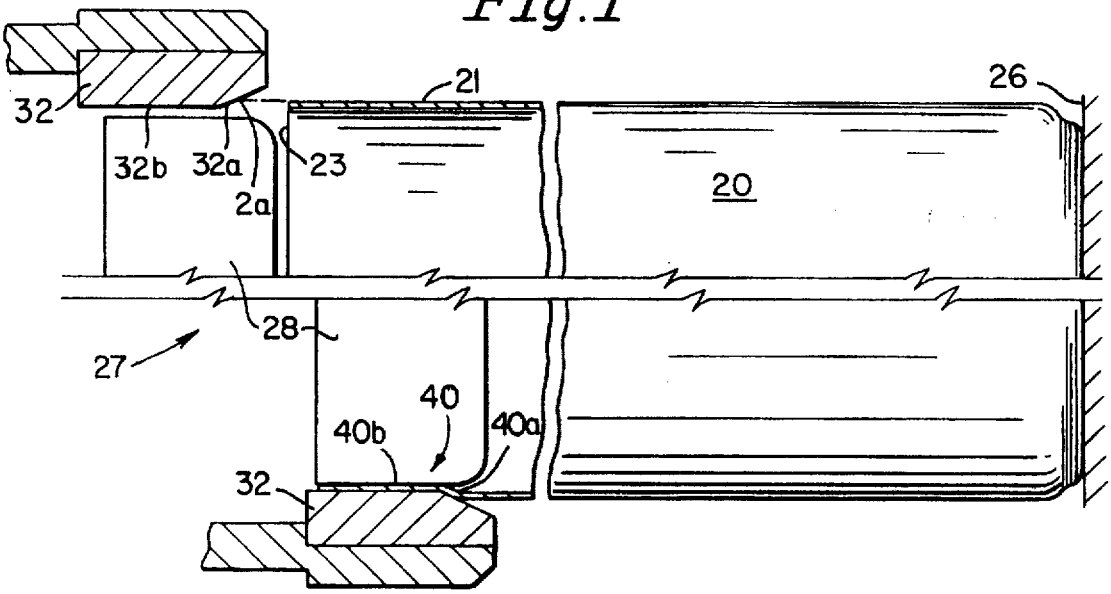
FIG. 1 schematically illustrates one step of the multi-stage novel die-necking process of the invention whereby a first reduced diameter neck is formed, the neck having an axial length corresponding essentially to the desired length of the finished neck on the can.

The can making process of the invention may be carried out by known conventional equipment having a plurality of necking-in stations corresponding in number to the number of necking-in steps required to provide the finished neck diameter, for example, six necking-in steps for producing a 206 diameter. These steps operate on the open end of a cylindrical can 20 to form a smooth necked-in portion 22 (FIG. 4) which is ready after suitable flanging to accept an end cap of a desired diameter, for example a 206 diameter. Each station includes a turret mechanism mounted for rotation about a horizontal axis and adapted to receive from a suitable feed mechanism a plurality of cans 20 and to support each of those cans in a horizontal position with the bottom of the cans engaged against a rotating base 26. At one station, associated with each can is a necking die assembly 27 which includes an inner guide block 28 which enters into the open end of can 20 and an outer die 32 which engages against the outside surface of the cylindrical wall 21 of can 20 to form the desired reduced neck configuration. Base 26 and die assembly 27 rotate together with the turret mechanism, but guide block 28 and forming die 32 are cam-operated for axial movement toward and away from open end of can 20 to perform the necking-in operation at each of the die-necking stations. Except for the configuration and specific movement of the dies, the apparatus used in practicing the invention is conventional.

The drawings illustrate the successive die-necking steps involved in reducing the open end of a 211 can down to a neck suitable to receive, for example, a 206 end cap. The thickness of the cylindrical wall of aluminum can 20 may be in the area of 0.005 to 0.0075 inches. The process may be operated at a speed to produce about 1500 to 2400 necked-in cans per minute.

Figure 4:
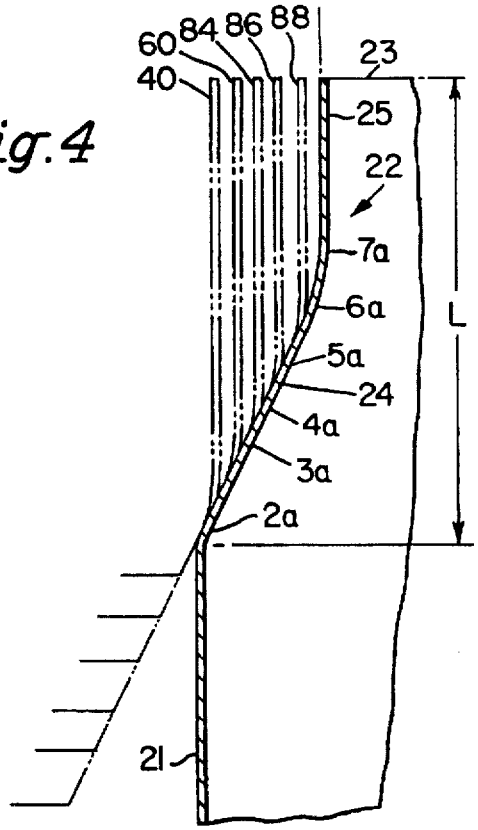
FIG. 4 is an enlarged schematic illustration on a scale of about 4.5 to 1 of the neck profiles which are formed by each of six steps employed in producing, for example, a 206 diameter neck.

Referring to FIG. 4, typically it is desirable to provide a can 20 with a reduced diameter neck 22 extending from the upper terminal edge 23 of the can, axially downwardly a length L where it joins at a circular line **2*a* the cylindrical sidewall 21 of the can. Neck 22 includes a smooth, inwardly tapered portion 24 extending from line 2*a* of cylindrical sidewall 21 to a terminal cylindrical portion 25 which forms the open mouth of the can. It is desirable that the axial length L of the finished neck be minimized so as to maximize the height of the cylindrical wall from the bottom of the can to line 2*a***. This maximizes the amount of billboard space on the cylindrical wall of the can for labeling and advertising purposes. At the same time, the length A must be sufficient to avoid excessively stressing the metal during the neck forming process which would cause the formation of cracks and pleats in the finished neck.

In the process of the invention, in one die-forming step, the material at the open end of the can is deformed over the full length L to form a first reduced diameter neck. In the next step and in each subsequent step, each previously formed reduced diameter neck is preferably deformed by engagement with a respective necking-die having the same profile, but if desired for some purpose a die having a different profile may be used in one of those steps.

Referring to FIG. 1, the upper half of the figure illustrates the guide block 28 and die 32 positioned in their initial, non-operative positions, whereas the lower half of the figure illustrates the block and die actuated to their inner operative neck-forming positions. The same is true for the positions of the guide block and die in FIG. 2.

In the initial step of FIG. 1 the guide block 28 first enters within the open end of wall 21, followed by inward movement of die 32. The die-forming surface engages against the terminal edge 23 of cylindrical sidewall 21 at a circular line **2*a*, and continued inward movement of die 32 deforms the metal along an inwardly contoured surface portion 32*a* and thence between the outside diameter of guide block 28 and the inner diameter of die cylindrical portion 32*b*. The axial stroke of die 32 is adjusted so that the open end of the can penetrates axially between the outer diameter of block 28 and inner diameter of cylindrical surface 32*b* a sufficient distance to from a first reduced diameter neck 40 having an inwardly contoured portion 40*a* extending from circular line 2*a* to a cylindrical terminal portion 40*b* having an inner diameter about 0.075 inches smaller than the diameter of the cylindrical wall 21. The axial length of the first reduced diameter neck 40 from terminal edge 23 down to circular line 2*a*** corresponds to the desired length L of the finished neck.

It is to be understood that the one die-necking step illustrated in FIG. 1 may be preceded by one or more preliminary forming steps, for example, the preliminary step disclosed in U.S. Pat. No. 5,297,414 to prepare the open end of the can for the forming step of FIG. 1.

Figure 2:
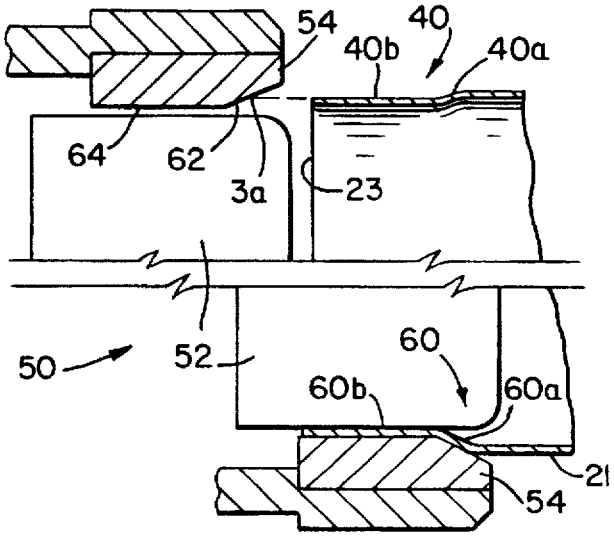
FIG. 2 illustrates the next step of the die-necking process of the invention which forms a second reduced diameter neck having a novel double radiused profile configured in accordance with the invention.
Figure 3:
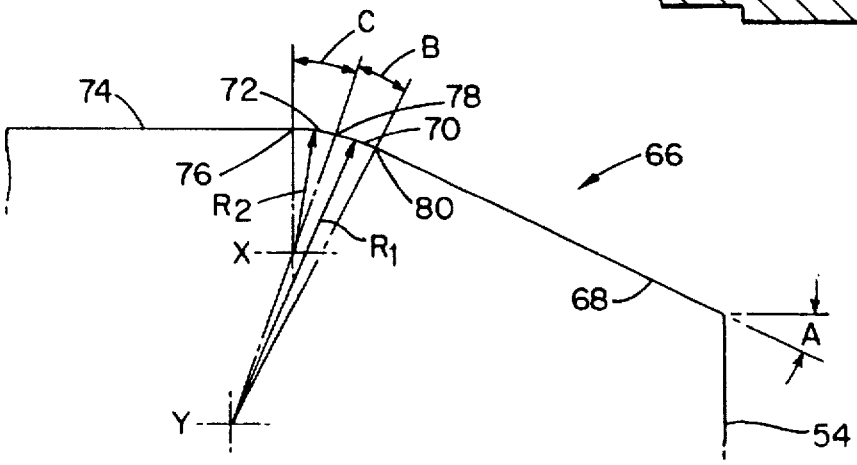
FIG. 3 schematically illustrates the profile of the necking die employed in the second step illustrated in FIG. 2 and preferably in each subsequent forming step of the multi-step process.

Referring now to FIGS. 2–4, at the next necking station the reduced diameter neck 40 is acted upon by a second die assembly 50 which includes a guide block 52 and a die 54 to form a second reduced diameter neck 60 at the open end of can 20. The configuration and profile of the die 54 is illustrated in FIG. 3 and in the enlarged schematic of FIG. 5 and includes a contoured portion 66 having a tapered section 68 which tapers inwardly at an entrance angle A within the range of 26°–30° with respect to the cylindrical wall 21. Tapered section 68 merges with a first radiused section 70 which curves away from the longitudinal axis of the die on a radius $R_1$ of about 0.275 inches. Section 70 then merges with a second radiused section 72 which curves away from the longitudinal axis of the die on a much smaller radius $R_2$, within the range of 0.080 to 0.140 inches, preferably approximately 0.120 inches. Section 72 at the die exit or throat 76 then joins a straight cylindrical die section 74 which has an internal diameter of about 0.055 inches less than the outer diameter of the first cylindrical portion **40*b* of neck 40. Radiused section 72 extends outwardly through an angular distance C from the point of intersection 76 with section 74, the center point X of $R_2$ being located on a line perpendicular to the axis of the die and passing through exit point 76. Radiused section 70 extends outwardly from the point of intersection 78 with section 72 through angular distance B to a point of intersection 80 with the straight tapered section 68. The center point Y of $R_1$ lies on a line passing through point 78** and center point X.

It has been found that the sum of the angles B and C must equal the angle of tangency D of the contact point 90 of the leading edge of the can wall on section 70, which is axially and radially inwardly of the point of intersection 80 of sections 68 and 70, the angle D thus being slightly less than angle A. Angle C can not exceed 12°. In a prototype of the invention, with the entrance angle A at 27°, angle D at 26.5°, the radius $R_2$ at 0.120 inches, it was determined that the die performed best when the angle B was 18.5° and the angle C was 8°.

Referring again to FIG. 2, as the turret assembly rotates, guide block 52 enters centrally into the open mouth of the first reduced diameter neck 40 and die 54 then moves inwardly so that the first radiused section 70 contacts edge 23 at a circular line **3*a* (FIG. 4). As the die 54 continues to move inwardly, the metal constituting neck portions 40*a* and 40*b* are reformed by engagement with die sections 70 and 72, and by axial penetration between the outer diameter of guide block 52 and the inner diameter of cylindrical die surface 74. The axial stroke of die 54 is adjusted so that the open end of the can penetrates a sufficient distance between the outer diameter of block 52 and the inner diameter of cylindrical die surface 74 to form a second reduced diameter neck 60, illustrated in FIG. 4**.

The second reduced diameter neck 60 will then have an inwardly contoured portion **60*a* conforming to the contoured portion 66 of die 54 and extending from cylindrical wall 21 at circular line 3*a* to a second reduced cylindrical portion 60*b* having a diameter about 0.055 inches smaller than the diameter of the cylindrical portion 40*b* of neck 40**.

In each subsequent forming step in which reduced diameter necks 84, 86, 88, and 22, respectively, are formed (FIG. 4), the profile of the die is preferably the same as that shown in FIG. 3, but, of course, the internal diameter of the cylindrical surface 74 of each successive die is about 0.055 inches less than that of the previous die. In those subsequent steps in which necks 84, 86, 88, and 22 are formed, the part of the previous neck in contact with a die 54 is the axial length from terminal edge 23 down to circular lines **4*a*, 5*a*, 6*a*, and 7*a***, respectively.

As mentioned above, tapered angle A may be within the range of 26°–30°. Of course, the greater the angle, the shorter the axial length L of the finished neck, and thus the more billboard space available on the can for advertising purposes. In the abovementioned prototype in which the entrance angle A was 27°, the axial length of the finished neck was approximately 0.640 inches, and virtually no pleating problems occurred. In more conventional processes in which smooth necks are produced with acceptable pleating levels, the length of the neck is more in the range of 0.750 inches.

It is significant that all of the dies used in the forming steps subsequent to the initial step of FIG. 1 preferably have the same profile. This greatly simplifies the construction of the dies, and reduces their cost.

As mentioned above, for a double radius die the value of radius $R_2$ is within the range of 0.080 to 0.140 inches, and preferably is approximately 0.120 inches. It has been found that a radius R2 less than 0.080 inches often produces circumferential lines or ribs within the finished neck, and that a radius $R_2$ above 0.140 inches increased the likelihood of pleats being formed in the neck.

While the exact limitations of the value of $R_1$ are not dearly known, the prototype performed best when R1 was approximately 0.275 inches. It is thought that any radius substantially less than 0.275 inches may cause work hardening of the metal, while a radius $R_1$ substantially greater than that value will cause an unacceptable amount of pleating. For example, a radius R1 of about 0.800 inches or 0.900 inches is considered to be too large, and it may act as a flat which creates problems. Computer modelling predicts that the radius $R_1$ should be less than 0.500 inches.

Figure 5:
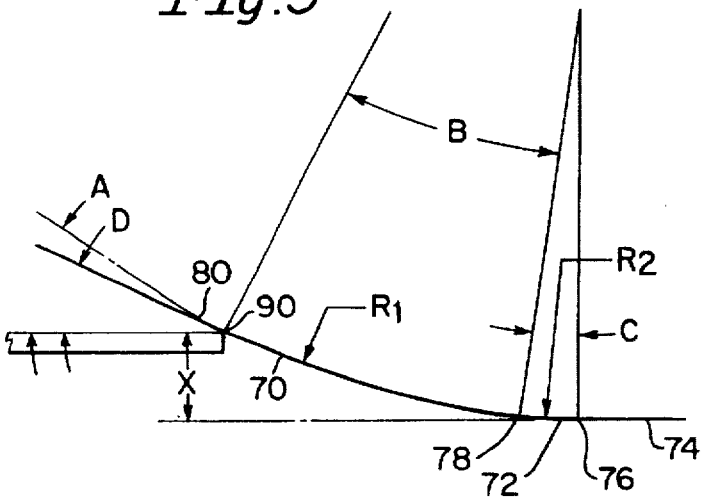
FIG. 5 is an enlarged schematic illustration of the double radiused forming surface profile of the die of FIG. 3.

Table I presents various combinations of radii $R_1$ and $R_2$ and angles B and C which are expected to work well together for the double radiused die of FIG. 5. The values are presented for three different angles of tangency used with a reduction X of 0.0275 inches (diameter reduction of 0.055 inches).

TABLE I

| $R_2$ | C | $R_1$ | B |
|---|---|---|---|
| | 1. X = .0275, D = 26.5° | | |
| .080 | 4° | .266 | 22.5° |
| .100 | 6° | .271 | 20.5° |
| .120 | 8° | .276 | 18.5° |
| .140 | 10° | .282 | 16.5° |
| | 2. X = .0275, D = 28.5° | | |
| .080 | 4° | .226 | 24.5° |
| .100 | 6° | .233 | 22.5° |
| .120 | 8° | .236 | 20.5° |
| .140 | 10° | .239 | 18.5° |
| | 3. X = .0275, D = 30.5° | | |
| .080 | 4° | .201 | 26.5° |
| .100 | 6° | .203 | 24.5° |
| .120 | 8° | .205 | 22.5° |
| .140 | 10° | .206 | 20.5° |

Figure 6:
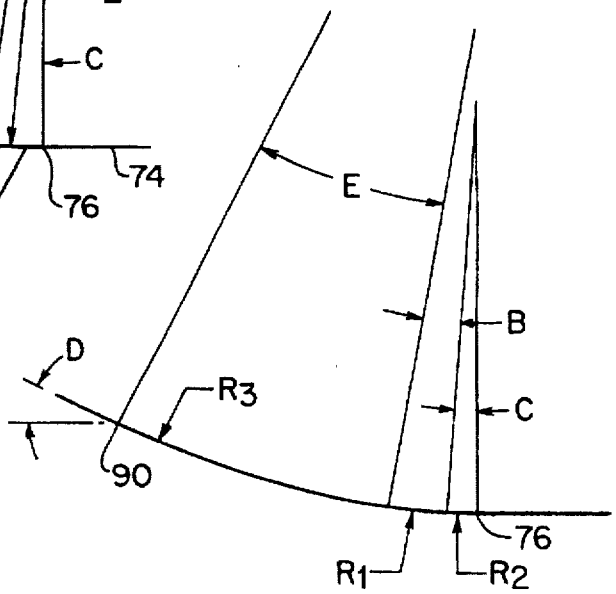
FIG. 6 is an enlarged schematic illustration of a triple radiused forming surface profile of a die constructed in accordance with the invention.

Table II presents various combinations of radii $R_1$, $R_2$ and $R_3$ and angles B, C, and E which are expected to work well together for the triple radiused profile die of FIG. 6. The values are presented for an angle of tangency D of 27° and a reduction X of 0.0275 inches.

TABLE II

| $R_2$ | C | $R_1$ | B | $R_3$ | E |
|---|---|---|---|---|---|
| .080 | 4° | .200 | 6° | .275 | 17° |
| .080 | 4° | .218 | 9° | .279 | 14° |
| .080 | 4° | .226 | 11.5° | .284 | 11.5° |
| .100 | 4° | .181 | 6° | .277 | 17° |
| .100 | 4° | .204 | 9° | .282 | 14° |
| .100 | 4° | .215 | 11.5° | .289 | 11.5° |
| .100 | 6° | .247 | 7° | .276 | 14° |
| .100 | 6° | .251 | 9° | .277 | 12° |
| .100 | 6° | .253 | 10.5° | .279 | 10.5° |
| .120 | 4° | .162 | 6° | .279 | 17° |

TABLE II-continued

| $R_2$ | C | $R_1$ | B | $R_3$ | E |
|---|---|---|---|---|---|
| .120 | 4° | .191 | 9° | .285 | 14° |
| .120 | 4° | .203 | 11.5° | .294 | 11.5° |
| .120 | 6° | .219 | 7° | .281 | 14° |
| .120 | 6° | .228 | 9° | .285 | 12° |
| .120 | 6° | .233 | 10.5° | .288 | 10.5° |
| .120 | 8° | .274 | 9° | .276 | 10° |
| .140 | 4° | .143 | 6° | .281 | 17° |
| .140 | 4° | .177 | 9° | .289 | 14° |
| .140 | 4° | .192 | 11.5° | .298 | 11.5° |
| .140 | 6° | .192 | 7° | .286 | 14° |
| .140 | 6° | .206 | 9° | .292 | 12° |
| .140 | 6° | .213 | 10.5° | .297 | 10.5° |
| .140 | 8° | .241 | 9° | .290 | 10° |
| .140 | 9° | .261 | 9° | .287 | 9° |

Figure 7:
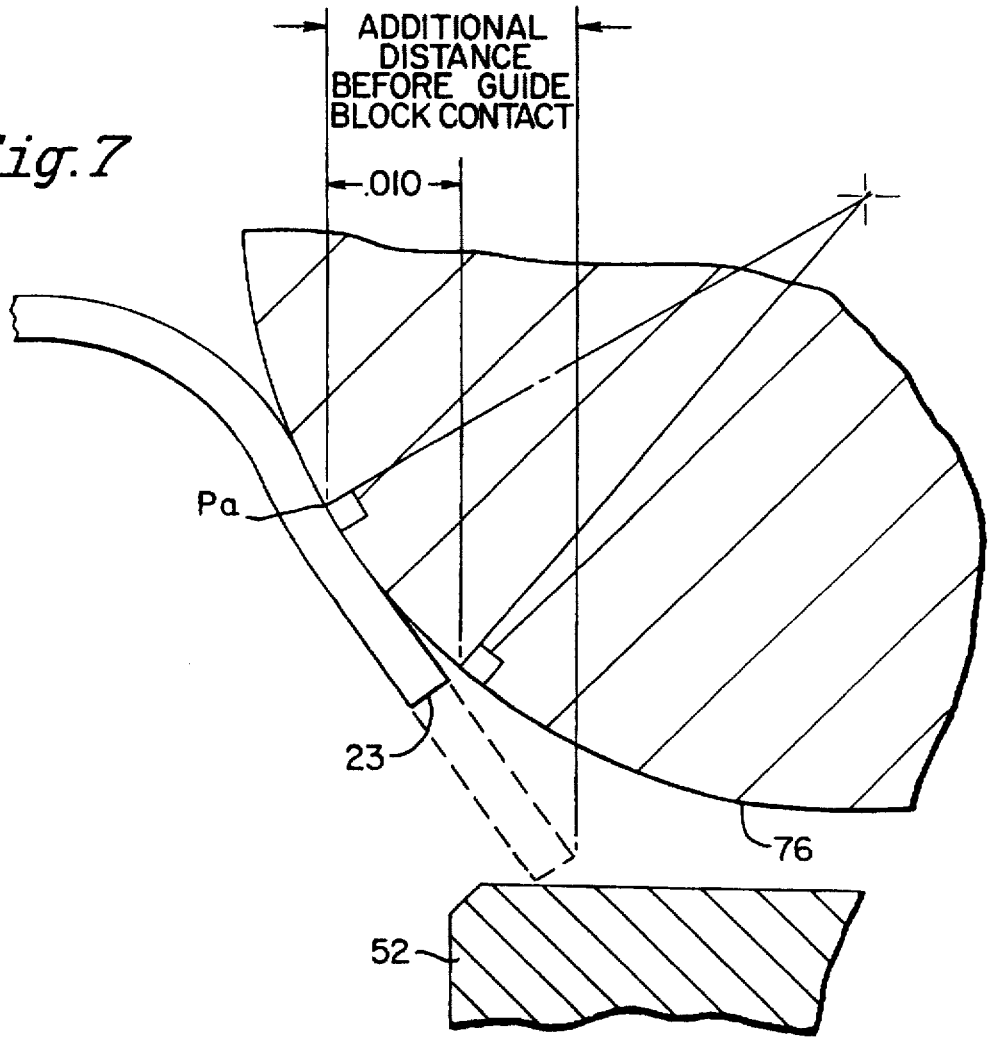
FIG. 7 is an enlarged schematic of a necking step illustrating the leading edge of the can wall leaving the forming surface of the die and penetrating axially uncontrolled toward the exit of the die and the guide block.

As mentioned initially above, it is desirable to maintain contact of the leading edge of the can with the profiled forming surface of the die through the entire necking operation from the entrance into the die to the exit. FIG. 7 schematically illustrates the leading edge 23 of the can leaving the surface of the die at a point Pa spaced axially a distance in the direction of penetration from the die exit or throat 76. To reduce wrinkles in the leading edge this distance must be minimized and ideally should be zero.

When the leading edge leaves the die surface, it loses three dimensional curvature and becomes a cone. The cone is much weaker than the toms shape and thus is easier to wrinkle. As the can continues to penetrate into the die, the length of the cone increases until it hits the inner guide block. The resistance of the cone to wrinkling is either a squared or cubic relationship to the length, i.e. a length twice as long could be eight times more likely to wrinkle. This is analogous to the known cubic relationship of can wall thickness to wrinkle resistance. The length of the unsupported cone is essentially the same as the amount of penetration left when the edge leaves the die. Obviously delaying the point where the edge leaves the die reduces the unsupported cone length and thus reduces wrinkles in the leading edge.

When the leading edge contacts the guide block, the leading edge is pushed back into contact with the surfaces of the die. Any small wrinkles are removed, but large ones will remain and create a pleat in the finished can.

The best way to look at the ability of a necking die to constrain the leading edge is to compare a point some distance back from the leading edge with the leading edge.

Figure 8:
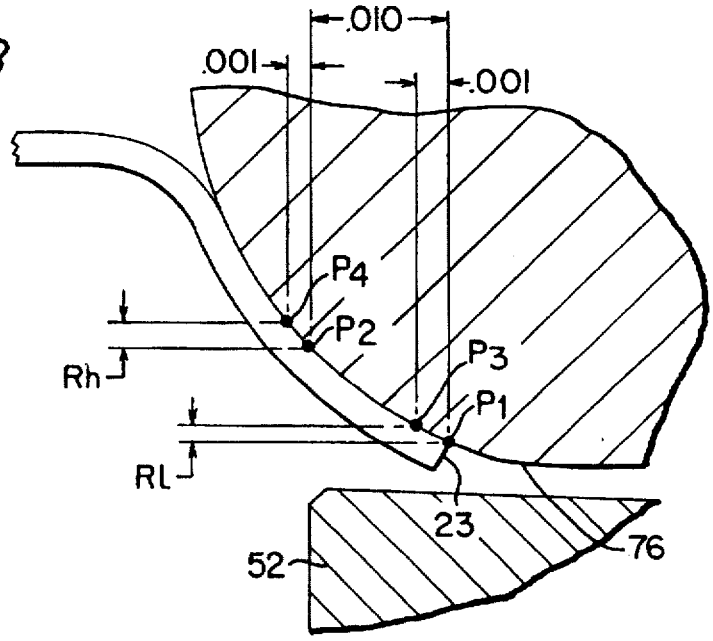
FIG. 8 is an enlarged schematic of a can wall engaging a die surface illustrating the differential reduction phenomenon by which contact can be maintained.

FIG. 8 defines the methodology used to compare the edge with a point further back in the die. Point $P_1$ is at the leading edge and point $P_2$ is located 0.010" (penetration distance) behind the leading edge. Point $P_3$ is 0.001" (penetration distance) behind point $P_1$ and point $P_4$ is 0.001" behind (penetration distance) point $P_2$. The amount of reduction occurring at the leading edge is defined by R1 and the reduction 0.010" behind the leading edge is Rh.

The diagram shows that Rh is always larger than R1. As the can is pushed further into the die, R1 gets smaller and eventually goes to zero. If Rh becomes substantially larger than R1, then the reduction behind the leading edge forces the leading edge away from the die as shown in FIG. 7.

Figure 9:
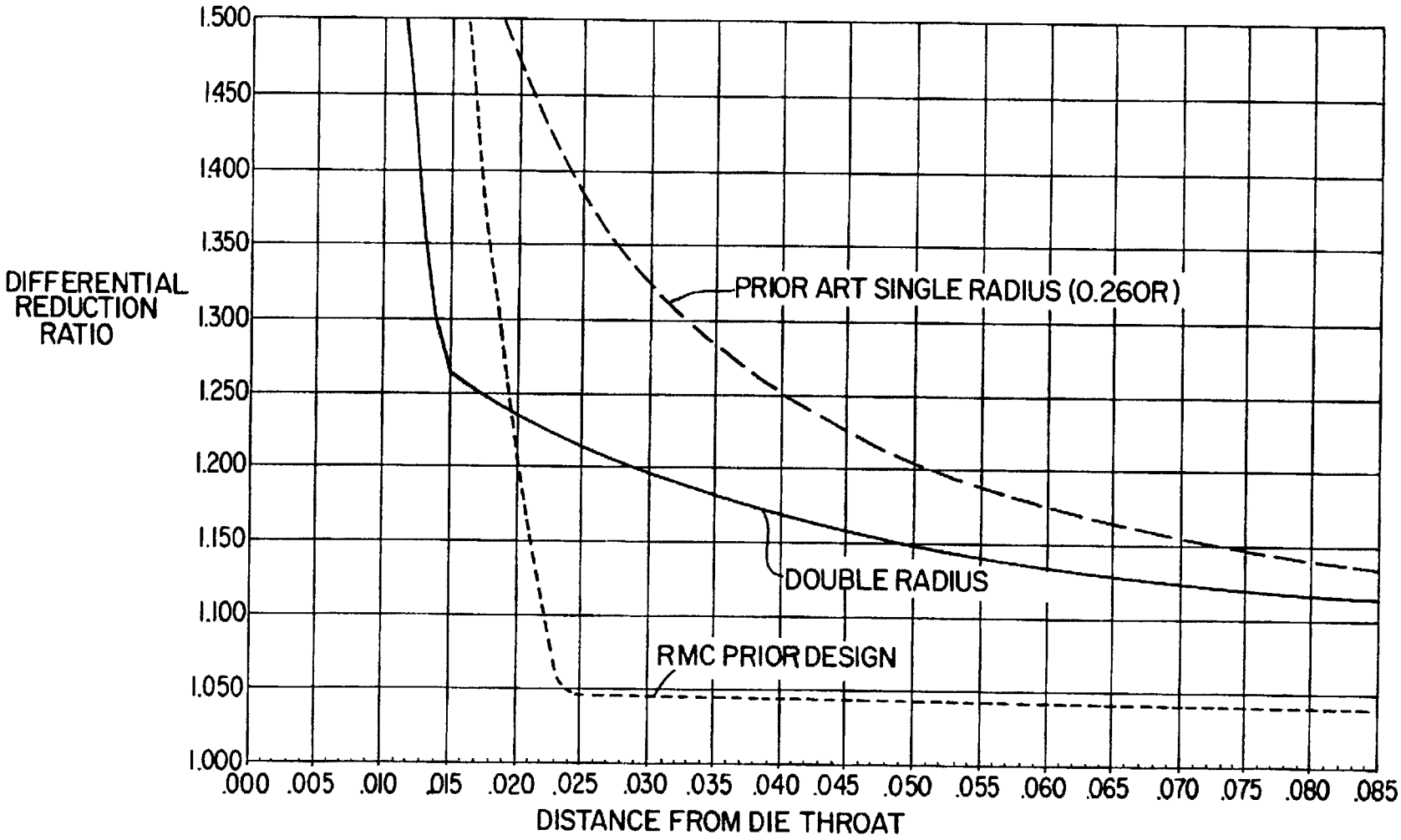
FIG. 9 is a chart showing differential reduction ratio versus distance from the die exit or throat for a conventional single radius die, the assignee's prior multi-radius die described above, and a double radiused die constructed in accordance with the invention.

Tests have shown that a trailing reduction of more than 30% greater than the leading edge reduction will cause this leading edge to leave the surface of the die. In other words, a differential reduction ratio (Rh/R1) of more than 1.3 causes the leading edge to leave the die. FIG. 9 is a chart showing differential reduction ratio versus distance from the die throat for a conventional single radius necking die, for the assignee's prior multi radius die using a large entrance radius of 0.900 inches, and the double radius die of this invention. The double radiused necking die of FIGS. 3 and 5, does not reach the critical 1.3 ratio until the can is much closer to the die throat as compared to the other processes (approximately 0.013 inches).

Figure 10:
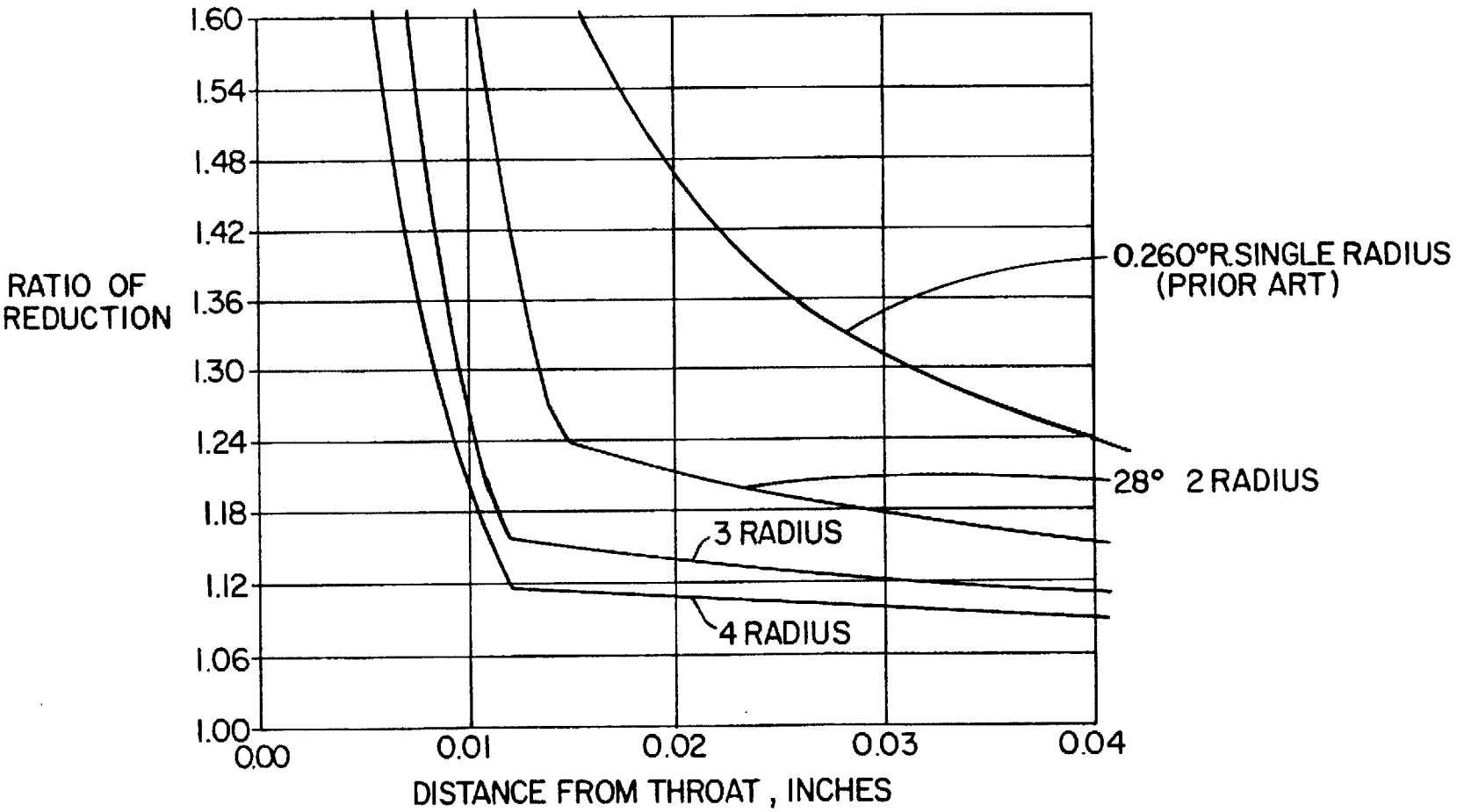
FIG. 10 is a chart similar to FIG. 9, illustrating computer modelling graphs for three and four radius dies constructed according to the invention.

Computer modelling predicts that three and four radius dies will perform even better. For example, a three radius die having a tangency angle of contact of 27°, an entrance radius of 0.500 inches through 18°, an intermediate radius of 0.120 inches through 5° and an exit radius of 0.080 inches through 4° will not reach the critical 1.3 ratio until the leading edge of the can is approximately 0.010 inches from the exit or throat (FIG. 10). Similarly a four radius die having a tangency angle of contact of 27°, an entrance radius of 0.600 inches through 16°, a next radius of 0.150 inches through 4°, a next radius of 0.080 inches through 4°, and an exit radius of 0.045 inches through 3° will not reach the critical 1.3 ratio until the leading edge of the can is approximately 0.008 inches from the exit (FIG. 10).

A theoretical "Best Profile" profile would be generated if the necking die profile were a constantly varying, constantly decreasing radius such that the reduction ratio is kept under 1.3 for as long as possible. One means of producing such a profile would be to generate the die profile using a parabolic function or even more extreme, an Archimedes spiral.

It should be noted that in all the above multi-radius forming profiles of the invention, each successive radius from the entrance to the exit of the die is smaller than the previous radius and the angle through which each successive radius extends is equal to or smaller than the angle of the previous radius. The angle of the exit radius must not exceed 12°.

It is anticipated that the novel multi-radius die configurations of the invention will also result in a reduction of the number of stations required in the die necking process since the dies are expected to produce a greater reduction in neck diameter at each station than was possible in the past.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A multi-stage die-forming method for necking-in the open end of a can body to form a reduced diameter neck having a smooth profile comprising the steps of:

providing an open-ended can body having a sidewall of substantially cylindrical configuration about a longitudinal central axis, the sidewall defining an open end having a terminal edge;

at one die-forming station, causing relative axial movement between a first necking-die and the open end of the sidewall to engage the first die against the sidewall to form a first reduced diameter neck having a first contoured portion extending inwardly from said sidewall to a first cylindrical portion terminating at said terminal edge;

at a next die-forming station, causing relative axial movement between a second necking-die and the first neck to engage the second die against the first neck to form the first neck into a second reduced diameter neck having a second contoured portion extending inwardly from said sidewall to a second cylindrical portion terminating at said terminal edge, the diameter of the second cylindrical portion being less than the diameter of the first cylindrical portion;

the second contoured portion having a first section extending inwardly from said sidewall at a minimum entrance angle of approximately 26°, a second radiused section joining said first section and curving away from said longitudinal axis on a radius substantially less than 0.900 inches, and a third radiused section curving away from said longitudinal axis and joining said second radiused section to said second cylindrical portion, the radius of said third section being substantially less than the radius of said second section, the angular distance through which said second section extends along the direction of said longitudinal axis being at least equal to the angular distance through which the third section extends, the sum of the angular distances being equal to said entrance angle; and at a subsequent die-forming station, causing relative axial movement between a third necking-die and the second neck to engage the third die against the second neck to form the second neck into a third reduced diameter neck having a third contoured portion extending inwardly from said sidewall to a third cylindrical portion terminating at said terminal edge, the diameter of the third cylindrical portion being less than the diameter of the second cylindrical portion, the third contoured portion having a profile which is substantially the same as the profile of said second contoured portion.

2. The die-forming method of claim 1, wherein the radius of said third section is within the range of 0.080 to 0.140 inches.

3. The die-forming method of claim 2, wherein the radius of said third section is 0.120 inches.

4. The die-forming method of claim 2, wherein the angular distance through which said third section extends does not exceed 12°.

5. The die-forming method of claim 2, wherein the radius of the second section does not exceed 0.500 inches.

6. The die-forming method of claim 5, wherein the radius of said second section is approximately 0.275 inches.

7. A multi-stage die-forming method for necking-in the open end of a can body to form a reduced diameter neck having a smooth profile comprising the steps of:

providing an open-ended can body having a sidewall of substantially cylindrical configuration about a longitudinal central axis, the sidewall defining an open end having a terminal edge;

at one die-forming station, causing relative axial movement between a first necking-die and the open end of the sidewall to engage the first die against the sidewall to form a first reduced diameter neck having a first contoured portion extending inwardly from said sidewall to a first cylindrical portion terminating at said terminal edge;

at a next die-forming station, providing a second necking die having a contoured surface including a first section extending inwardly from said sidewall at a minimum entrance angle of approximately 26°, a second radiused forming section joining said first section and curving away from said longitudinal axis at a radius substantially less than 0.900 inches, and a third radiused forming section curving away from said longitudinal axis and joining said second radiused section to a cylindrical section, the radius of said third section being less than the radius of said second section, the angular distance through which said second section extends along the direction of said longitudinal axis being at least equal to the angular distance through which the third section extends, the sum of the angular distances being equal to said entrance angle, and causing relative axial movement between said second necking-die and the first neck to engage the first neck against the radiused forming sections of the second necking die to form the first neck into a second reduced diameter neck having a second contoured portion extending inwardly from said sidewall to a second cylindrical portion terminating at said terminal edge, the diameter of the second cylindrical portion being less than the diameter of the first cylindrical portion;

at a subsequent die-forming station, providing a third necking die including a contoured surface having a profile which is substantially the same as the profile of the contoured surface of said second die and causing relative axial movement between said third necking-die and the second neck to engage the second neck against the contoured surface of the third die to form the second neck into a third reduced diameter neck having a third contoured portion extending inwardly from said sidewall to a third cylindrical portion terminating at said terminal edge, the diameter of the third cylindrical portion being less than the diameter of the second cylindrical portion.

8. The die-forming method of claim 7, wherein the radius of said third section is within the range of 0.080 to 0.140 inches.

9. The die-forming method of claim 8, wherein the radius of said third section is 0.120 inches.

10. The die-forming method of claim 8, wherein the angular distance through which said third section extends does not exceed 12°.

11. The die-forming method of claim 8, wherein the radius of the second section does not exceed 0.500 inches.

12. The die-forming method of claim 11, wherein the radius of said second section is approximately 0.275 inches.

13. A die-forming method for necking-in the open end of a can body to form a reduced diameter neck having a smooth profile comprising the steps of:

providing an open-ended can body having a sidewall of substantially cylindrical configuration about a longitudinal central axis, the sidewall defining an open end having a terminal edge;

at one die-forming station, providing a necking die having a contoured surface including a first section extending inwardly from sidewall at an entrance angle, a second radiused forming section joining said first section and curving away from said longitudinal axis at a radius substantially less than 0.900 inches, and a third radiused forming section curving away from said longitudinal axis and joining said second radiused section to a cylindrical section, the radius of said third section being less than the radius of said second section, the angular distance through which said second section extends along the direction of said longitudinal axis being at least equal to the angular distance through which the third section extends, the sum of the angular distances being equal to said entrance angle; and causing relative axial movement between the necking die and the open end of the sidewall to engage the sidewall against the radiused forming surfaces of the die to form a reduced diameter neck having a contoured portion extending inwardly from said sidewall to a cylindrical portion terminating at said terminal edge.

14. The die forming method of claim 13, comprising a subsequent die forming station, providing a second necking die including a contoured surface having a profile which is substantially the same as the profile of the contoured surface of the first die and causing relative axial movement between the second necking die and the first neck to engage the first neck against the contoured surface of the second die to form the first neck into a second reduced diameter neck having a second contoured portion extending inwardly from the sidewall to a second cylindrical portion terminating at said terminal edge, the diameter of the second cylindrical portion being less than the diameter of the first cylindrical portion.

15. The die-forming method of claim 14, wherein the radius of the third section is within the range of 0.080 to 0.140 inches.

16. The die-forming method of claim 15, wherein the radius of said third section is 0.120 inches.

17. The die-forming method of claim 15, wherein the angular distance through which said third section extends does not exceed 12°.

18. The die-forming method of claim 15, wherein the radius of the second section does not exceed 0.500 inches.

19. The die-forming method of claim 18, wherein the radius of said second section is approximately 0.275 inches.

20. A die-forming method for necking-in the open end of a can body to form a reduced diameter neck having a smooth profile comprising the steps of:

providing an open-ended can body having a sidewall of substantially cylindrical configuration about a longitudinal central axis, the sidewall defining an open end having a terminal edge;

at one-die forming station, providing a necking die having a multi-radiused forming surface, each successive radius from the entrance to the exit of the die being smaller than the previous radius and the angle through which each successive radius extends being equal to or smaller than the angle of the previous radius, the sum of the angular distances through which all the radii extend being substantially equal to the angle of tangency with which the leading edge of the can wall engages the entrance radius of the die; and causing relative axial movement between the necking die and the open end of the sidewall to engage the sidewall against the multi-radiused forming surface of the die to form a reduced diameter neck having a contoured portion extending inwardly from said sidewall to a cylindrical portion terminating at said terminal edge.

21. The die-forming method of claim 20, wherein the angle of the exit radius does not exceed 12°.

22. The die forming method of claim 20, comprising a subsequent die forming station, providing a second necking die including a multi-radius forming surface having a profile which is substantially the same as the profile of the forming surface of the first die and causing relative axial movement between the second necking die and the first neck to engage the first neck against the forming surface of the second die to form the first neck into a second reduced diameter neck having a second contoured portion extending inwardly from the sidewall to a second cylindrical portion terminating at said terminal edge, the diameter of the second cylindrical portion being less than the diameter of the first cylindrical portion.

* * * * *